United States Patent [19]

Graf

[11] 4,378,477

[45] Mar. 29, 1983

[54] GAS-BLAST SWITCH

[75] Inventor: Rudolf Graf, Obermuhen, Switzerland

[73] Assignee: Sprecher & Schuh AG, Aarau, Switzerland

[21] Appl. No.: 177,642

[22] Filed: Aug. 13, 1980

[30] Foreign Application Priority Data

Sep. 25, 1979 [CH] Switzerland ..... 8626/79

[51] Int. Cl.[3] ..... H01H 33/70; H01H 33/24

[52] U.S. Cl. ..... 200/148 R; 200/148 A; 200/146 R

[58] Field of Search ..... 200/148 A, 146 R, 148 R

[56] References Cited

U.S. PATENT DOCUMENTS 4,132,876 1/1979 Sato et al. ..... 200/148 A 4,296,288 10/1981 Yanabu et al. ..... 200/146 R

FOREIGN PATENT DOCUMENTS 2273362 12/1975 France ..... 200/148 A

*Primary Examiner*—Robert S. Macon

*Attorney, Agent, or Firm*—Werner W. Kleeman

[57] ABSTRACT

A gas-blast switch provided with two coaxially arranged contact elements which can be brought into and out of engagement with one another by carrying out an axial movement. The first contact element which is connected with a drive is arranged in a fixed reference position forwardly of a blast nozzle. The blast nozzle is connected at its inlet side with a compression chamber or space which can be pressurized during the cut-off stroke of the gas-blast switch. In the cut-on stroke of such gas-blast switch the second contact element engages with the blast nozzle. The second contact element is surrounded by a screening body which, in turn, can be shifted back by means of the blast nozzle, during a cut-on stroke of the gas-blast switch, out of its advanced position in the cut-off position, against the action of a spring, along the second contact element. In order to more rapidly increase the spacing between both contact elements at the start of a cut-off stroke than such would correspond to the path of the cut-off stroke, the screening body and the second contact element are coupled with one another so as to perform opposite movements in relation to one another.

8 Claims, 3 Drawing Figures

GAS-BLAST SWITCH

BACKGROUND OF THE INVENTION

The present invention relates to a new and improved construction of a gas-blast switch.

Generally speaking, the gas-blast switch of the present development is of the type comprising two coaxially arranged contact elements which, by performing an axial movement, can be brought into and out of engagement with one another. The first contact element, which is connected with a drive, is arranged forwardly in a fixed reference position with respect to a blast nozzle. The blast nozzle is connected at its inlet side with a compression chamber or space for an extinguishing gas, this compression chamber being pressurized during the cut-off stroke of the gas-blast switch. The second contact element engages with the blast nozzle in the cut-on position of the gas-blast switch. Further, the second contact element is surrounded by a screening body or element which, by means of the blast nozzle during a cut-on stroke, can be shifted out of its position which is advanced during the cut-off position, against the action of a spring, rearwardly along the second contact element.

Such gas-blast switches are known, by way of example, from Swiss patent No. 554,597 or German patent publication No. 2,140,284. With these gas-blast switches the screening body, during a cut-off stroke, has assigned to it the function of rendering uniform the electrical field which emanates from the end of the second contact element which as a rule is of tubular-shaped configuration, in order that, following extinguishing of the switching arc, there do not exist any extreme values of the field intensity.

The spring, whose force is applied to the screening body, additionally affords the advantage that towards the end of a cut-on stroke the thus moved parts of the gas-blast switch are effectively delayed. Hence, there is also stored a part of the mechanical force which is applied during the cut-on stroke by the switch drive, by the spring until the next following cut-off stroke and such then augments the cut-off stroke.

With the heretofore known gas-blast switches the second contact element, which is operatively associated with the screening body, is stationarily arranged. As a result, the path through which moves the first contact element during a cut-off stroke must exactly correspond to the switching path which is present between the contact elements in the cut-off position. Additionally, it is a known fact that the separation path between the contact elements, i.e. the minimum distance which the contact elements must possess from one another, so that there is even realized at all an extinguishing of the switching arc, must be greater the greater the magnitude of the currents which are to be interrupted. It is of course to be strived for that the separation distance be reached as quickly as possible during a cut-off stroke. This requires that, with the state-of-the-art gas-blast switches that there be present a long stroke drive mechanism which, additionally, must have sufficient power output in order to cause the desired separation spacing or distance within a useful period of time.

SUMMARY OF THE INVENTION

Therefore, with the foregoing in mind it is a primary object of the present invention to provide a new and improved construction of a gas-blast switch which is not associated with the aforementioned drawbacks and limitations of the prior art constructions.

Another and more specific object of the present invention aims at providing a new and improved construction of gas-blast switch of the previously mentioned type wherein, while retaining the mentioned advantages which are afforded by the screening body and its spring, and while utilizing only one and then at that a relatively short stroke drive, there can be realized much more rapidly the separation distance or spacing, and furthermore, wherein the switching path present between the contact elements in the cut-off position of the gas-blast switch exceeds the length of the stroke of the drive.

Now in order to implement these and still further objects of the invention, which will become more readily apparent as the description proceeds, the gas-blast switch of the present development is manifested by the features that the screening body and the second contact element are coupled with one another so as to be able to perform opposite movements.

If therefore the blast nozzle, during the course of a cut-on stroke, rearwardly displaces the screening body, then the second contact element moves through the blast nozzle in the direction of the first contact element. Conversely, if, during a cut-off stroke the screening body can shift into its forwardly advanced position because of the retracting blast nozzle, then at the same time and additionally the second contact element moves away from the first contact element.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 3:
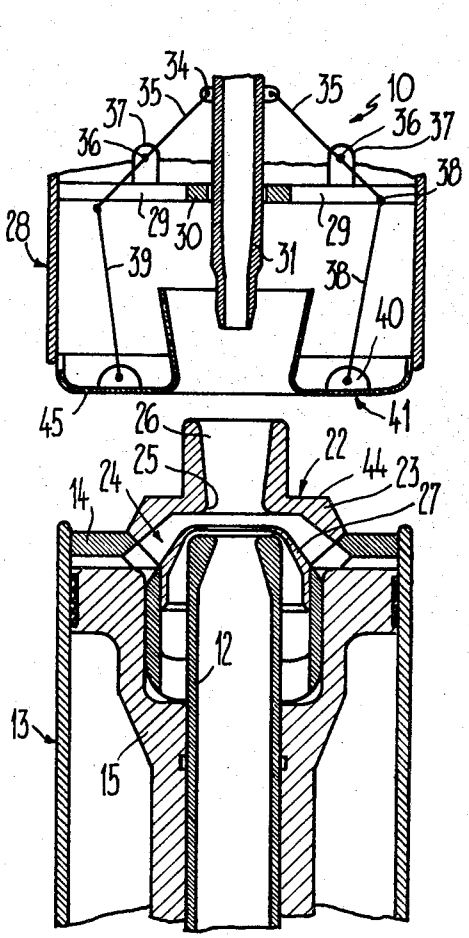
FIG. 3 is a schematic fragmentary axial sectional view, analogous to the showing of FIG. 1, showing the parts or components of the gas-blast switch in a still further position.
Figure 2:
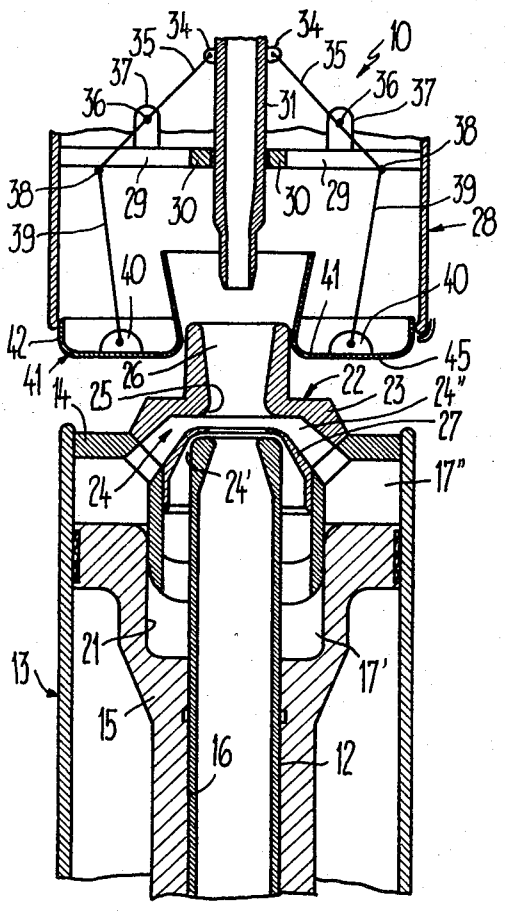
FIG. 2 is a schematic fragmentary axial sectional view of the gas-blast switch shown in FIG. 1, showing the parts in a different position.
Figure 1:
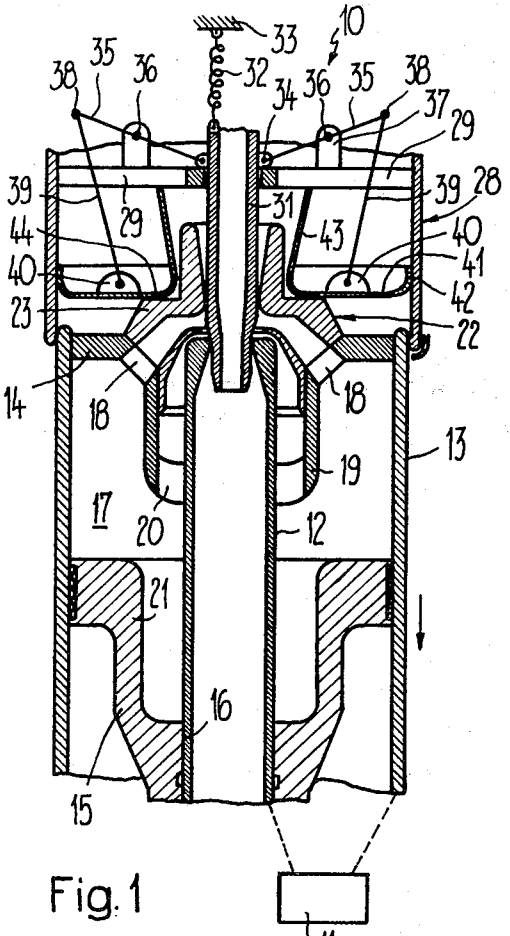
FIG. 1 schematically illustrates in fragmentary axial sectional view those components of a gas-blast switch constructed according to the invention which are essential for understanding the underlying principles of this development, with the parts or components being shown in a first position.

Describing now the drawings, it is to be understood that in FIGS. 1 to 3 there has been disclosed an exemplary embodiment of gas-blast switch 10, there having only been illustrated those parts or components of the switch which are needed to fully comprehend the underlying principles and concepts of the present development. In FIG. 1 the gas-blast switch 10 has been shown in its cut-on position, in FIG. 3 in its cut-off position and in FIG. 2 in an intermediate position. This gas-blast switch 10 will be seen to comprise two sets of contact elements or members. The first set is connected with a here only schematically illustrated but conventional switch drive 11 and encompasses a first, substantially tubular-shaped contact element 12 as well as a first, likewise tubular-shaped rated current contact 13. Both of these contacts or contact elements 12, 13 as will be still further described more fully hereinafter, are mechanically coupled with one another, so that they can move in each case in the same sense and through the same path. The first rated current contact 13 is closed at the region of its free end by a flange 14. Additionally, the first rated current contact 13 is mounted to be displaceable upon a stationarily supported pump piston 15. This pump piston 15 is provided with a central passageway or throughpass 16 within which there is displaceably mounted the first contact element 12. At least during the cut-on position of the gas-blast switch 10 there is thus enclosed by the flange 14, the inner surface of the first rated current contact 13, the outer surface of the first contact element 12 and the pump piston 15 of a pump chamber or compartment 17 which contains an extinguishing gas.

At the side of the flange 14, confronting the pump chamber or compartment 17, there is attached by means of webs or struts 18 or equivalent structure a substantially cylindrical extension or projection 19 which extends into the pump chamber 17. This extension or projection 19 is attached at the region of its free end, by means of further struts or webs 20 or equivalent structure, with the outer side or surface of the first contact element 12. On the other hand, within the pump piston 15 there is provided a recess or depression 21 which is configured so as to be the mirror-image of the extension or projection 19. This recess 21 serves to receive the extension or projection 19 during the course of a cut-off stroke of the gas-blast switch 10, so that, as will be readily apparent from the illustration of FIG. 2, the pump chamber 17 is subdivided into two mutually separated pump chambers or spaces 17' and 17''.

Continuing, there is essentially secured to the flange 14 a blast nozzle, generally designated by reference character 22, which is formed of any suitable electrically insulating material. This blast nozzle 22 comprises a nozzle body 23 which has an inlet region 24 which emanates from the not particularly reference intermediate spaces between the webs or struts 18, a throat portion or throat 25 as well as an outlet portion or region 26 which widens in the manner of a diffusor. At the inlet region 24 there is additionally provided a separation or partition wall 27 in the form of a hollow truncated cone. This partition wall subdivides the inlet region 24 into two mutually separated, but coaxial jacket-shaped inlet channels 24' and 24'' which converge towards the nozzle throat 25 (FIG. 2), and the inlet channel 24' always communicates with the pump chamber or space 17' and the inlet channel 24'' always flow communicates with the pump chamber or space 17''. As will be clearly evident from the drawings, the throughflow cross-sectional area of the inlet channel 24' is considerably smaller than that of the inlet channel 24''. This has the result that as soon as during the course of a cut-off stroke the projection or extension 19 begins to penetrate into the recess 21 the pressure increase within the pump changer or space 17' will be momentarily greater than within the pump chamber or space 17'' owing to the reduced flow possibility. Consequently, the extinguishing gases which are at high pressure and which are formed during the cut-off stroke particularly at the region of the narrowest location or throat 25 of the nozzle body 23 due to heating of such extinguishing gas—to the extent that such extinguishing gases cannot escape through the outlet region 26—only possibly flows back into the pump space or chamber 17'' and this only momentarily, whereas the blowing of the switching arc with fresh extinguishing gas continues by means of the pump chamber or space 17'.

By referring to FIG. 1 it will be seen that the first rated current contact 13 coacts with a second stationarily arranged and likewise substantially tubular-shaped rated current contact 28. Retained within this rated current contact 28, by means of metallic struts or webs 29, is a likewise metallic ring 30 in which there is mounted to be lengthwise displaceable a second, likewise substantially tubular-shaped contact element 31. From the showing of FIG. 1 it will be apparent that this second contact element 31, in the cut-on position, practically closes the blast nozzle 22 at its throat 25 and at the same time engages into the free end of the first contact element 12. At the end of the second contact element 31, which faces away from the first contact element 12, there is attached one end of a tension spring 32 which has only been schematically shown in FIG. 1, the other end of which spring is secured at a stationary point or location 33 within the gas-blast switch 10. This tension or traction spring 32 strives to upwardly draw the second contact element 31 in the showing of FIG. 1.

At the outer or jacket surface of the second contact element 31 there are provided a number of bearing eyelets 34 which are equidistantly arranged with respect to one another. At each bearing eyelet 34 there is hingedly connected one end of a double-arm lever 35 which, in turn, is pivotable about a pivot pin or shaft 36 in a bearing eyelet 37 formed in each case at a web or strut 29. The other end of each of the double-arm levers 35 is hingedly connected at location 38 at the one end of a rocker arm or balance 39. The other end of each rocker arm or balance 39 is hingedly connected with a bearing eyelet 40 which is anchored at the side of a screening body 41 which faces away from the blast nozzle 22. The screening body or screen 41 is formed of sheet metal, by way of example.

This screening body 41 possesses at its circumference an edge 42 which is flexed in the direction of the lever 35. This flexed or bent edge 42, at least in its forwardly advanced position in accordance with FIGS. 2 and 3 is in electrical contact with the contact surfaces of the second rated current contact 28. Additionally, this screening body 41 possesses at its central region an approximately funnel-shaped passageway or throughpass 43 which diverges away from the blast nozzle 22, this passageway 43, as best seen by referring to FIG. 1, being practically closed in the cut-on position of the gas-blast switch 10 by the outlet side region of the nozzle body 23. At the outer surface or side of the nozzle body 23 there is additionally formed a shoulder 44 which serves the purpose, during the cut-on stroke, i.e. during transition from the position shown in FIG. 3 into that shown in FIG. 1., of coacting with the end side or face 45 (FIGS. 2 and 3) of the screening body 41, which side 45 confronts the blast nozzle 22, and thus, displacing the screening body 41 back along the second contact element 31.

From what has been previously stated it will be seen that for the described gas-blast switch 10, at least during the start of the cut-off stroke, the increase of the separation distance or spacing between the contact elements 12 and 31 is appreciably greater than the actual path through which moves the contact element 12 which is directly driven.

The relationship of the displacement path of the screening body 41 and the (opposite) path of the second contact element 31 is dependent upon the "transmission ratio" or "mechanical advantage" of the lever 35.

As to the screening body 41, which in the first instance has assigned to it the task that, during a cut-off stroke, it will render the electrical field at the end of the contact elements 28 and 31 as uniform as possible, i.e. will assume the position according to FIG. 2, a comparatively small displacement path can suffice. On the other hand, it is advantageous to provide a relatively larger displacement path for the second contact element 31, so that the switching arc can be drawn in its length as quickly as possible, in order to favor extinguishing of the arc.

While there are shown and described present preferred embodiments of the invention, it is to be distinctly understood that the invention is not limited thereto, but may be otherwise variously embodied and practiced within the scope of the following claims.

Accordingly what I claim is:

1. A gas-blast switch comprising:

two coaxially arranged contact elements capable of being brought into and out of engagement with one another by carrying out an axial movement;

said two contact elements defining a first contact element and a second contact element;

means defining a compression chamber for an extinguishing gas;

a blast nozzle operatively connected with said compression chamber;

drive means operatively connected with said first contact element;

said blast nozzle having an inlet side;

said first contact element being arranged in a fixed reference position forwardly of the inlet side of said blast nozzle;

said compression chamber being pressurized during a cut-off stroke of said gas-blast switch;

said second contact element engaging with said blast nozzle during a cut-on position of said gas-blast switch;

a screening body surrounding said second contact element;

a spring acting upon said screening body;

said screening body being displaceable by means of said blast nozzle during a cut-on stroke of said gas-blast switch out of a position which is forwardly advanced during its cut-off position, against the action of said spring, along said second contact element;

means for movably mounting said second contact element; and means for operatively connecting said screening body to said second contact element for positively moving said second contact element in opposite direction with respect to said screening body.

2. A gas-blast switch comprising:

two coaxially arranged contact elements capable of being brought into and out of engagement with one another by carrying out an axial movement;

said two contact elements defining a first contact element and a second contact element;

means defining a compression chamber for an extinguishing gas;

a blast nozzle operatively connected with said compression chamber;

drive means operatively connected with said first contact element;

said blast nozzle having an inlet side;

said first contact element being arranged in a fixed reference position forwardly of the inlet side of said blast nozzle;

said compression chamber being pressurized during a cut-off stroke of said gas-blast switch;

said second contact element engaging with said blast nozzle during a cut-on position of said gas-blast switch;

a screening body surrounding said second contact element;

a spring acting upon said screening body;

said screening body being displaceable by means of said blast nozzle during a cut-on stroke of said gas-blast switch out of a position which is forwardly advanced during its cut-off position, against the action of said spring, along said second contact element;

means for operatively connecting said screening body and said second contact element with one another for opposite movement in relation to one another; and said means for interconnecting said screening body and said second contact element with one another comprises lever drive means.

3. The gas-blast switch as defined in claim 2, wherein:

said lever drive means has a transmission ratio selected such that the displacement path of the screening body is less than the displacement path of the second movable contact element.

4. The gas-blast switch as defined in claim 1, wherein:

said spring engages at said second movable contact element.

5. The gas-blast switch as defined in claim 4, wherein:

said spring comprises a tension spring;

said second movable contact element having an end facing away from said first contact element; and said spring engaging at said end of said second movable contact element.

6. The gas-blast switch as defined in claim 2, wherein:

said lever drive means comprises at least one double-arm lever;

a stationary pivot pin upon which there is mounted said double-arm lever;

said double-arm lever having opposed ends;

means for hingedly connecting one end of said double-arm lever at said second movable contact element;

rocker arm means;

means for hingedly connecting the other end of said double-arm lever at said rocker arm means; and means for hingedly connecting said rocker arm means with said screening body.

7. The gas-blast switch as defined in claim 1, wherein:

said screening body has a central opening structured as a diffusor which diverges away from said blast nozzle;

said blast nozzle having an outlet side;

said blast nozzle including a blast nozzle portion arranged at the region of said outlet side; and said outlet side portion of said blast nozzle engaging into said diffusor in the cut-on position of said gas-blast switch.

8. The gas-blast switch as defined in claim 1, further including:

a respective power contact means surrounding each said first contact element and said second movable contact element;

said power contact means each defining rated power contacts which can be brought into and out of engagement with one another; and said screening body being in sliding electrical contact with said rated power contact means which surrounds said second movable contact element.

* * * * *